United States Patent [19]

Wood

[11] Patent Number: 4,607,698

[45] Date of Patent: Aug. 26, 1986

[54] PIPE CONFIGURATION COMPATIBLE WITH CBL

[75] Inventor: Edward T. Wood, Kingwood, Tex.

[73] Assignee: Completion Tool Company, Houston, Tex.

[21] Appl. No.: 694,848

[22] Filed: Jan. 25, 1985

[51] Int. Cl.[4] ..... E21B 33/14; E21B 49/00

[52] U.S. Cl. ..... 166/285; 166/253; 138/145; 367/35; 181/105

[58] Field of Search ..... 166/285, 253, 250, 64, 166/113; 138/145, 175, 143, 153, 172; 367/25, 35; 181/102, 105, 112

[56] References Cited

U.S. PATENT DOCUMENTS

| | | | |
|---|---|---|---|
| 3,332,499 | 7/1967 | Harris et al. | 166/242 |
| 3,752,257 | 8/1973 | Davis | 367/35 |
| 3,955,600 | 5/1976 | Tamburello | 138/175 X |
| 4,463,807 | 8/1984 | Stoddard et al. | 166/285 |

*Primary Examiner*—Stephen J. Novosad
*Assistant Examiner*—David J. Bagnell

[57] ABSTRACT

A string of pipe is provided with intermittent coatings of grit-like materials bonded to the pipe to provide a rough surface for adhesion of cement in a cementing operation. Between the intermittent coatings are intermittent bare portions of pipe thereby to permit the use of a cement bonding tool. The spacings of the coatings is functionally related to the transmitter/receiver spacing for a cement bonding tool.

4 Claims, 3 Drawing Figures

PIPE CONFIGURATION COMPATIBLE WITH CBL

FIELD OF THE INVENTION

The present invention relates to pipe for use during the drilling or production of oil and gas wells for the purpose of providing a string of pipe with an outer coated and bonded surface to enhance the adhesion of cement in a cementing operation and to remove the adverse effects of coated bonded surface to sound transmission. More particularly, the present invention relates to coated pipe utilized in lining a well bore where cement is introduced into the annulus between the pipe and the wellbore and the coating does not adversely affect sound transmission.

BACKGROUND OF THE INVENTION

In the drilling and completion of oil wells, it is common to drill a section of borehole to a desired depth and then cement a liner or casing in the borehole. The liner or casing to be cemented in the bore carries with it conventional cementing equipment such as a cementing shoe, collar and valves. When the casing or liner is properly positioned in the borehole, a cement slurry is pumped through the casing or liner displacing mud and is passed from the casing shoe into the annulus between the casing or liner and the borehole. The cement slurry is moved upwardly in the annulus to the desired level and the cement slurry is permitted to set or cure. When the cement has set it is intended to provide load supporting strength for the casing or liner as well as provide a fluid seal with respect to the interfaces between the cement and borehole well and between the cement and the pipe or casing. For various reasons, it is not always possible to obtain a good bond between the outer surface of the casing or liner and the column of cement.

To enhance the bonding of cement to the casing it has heretofore been proposed to coat the outside of the liner or casing (sometimes referred to as "pipe") with a layer of material having a rough surface. The rough surface material is formed by bonding solid grit-like particles (sand, metal or the like) to the mandrel surface by a suitable binder such as an epoxy resin. The rough surface of the epoxy impregnated bonding material provides for increased roughness and particles on the surface of the pipe therefore improves the bonding relationship of the cement relative to the pipe. However, the addition of the epoxy and grit-like material to the pipe affects the acoustical transmission properties of the pipe. Thus, when a pipe is cemented in the borehole and a cement bond logging or log (CBL) tool is run through the pipe to obtain a cement bond log, it has been found that the amplitude of the sonic signal on the CBL log obtained by the CBL tool is increased which typically indicates a lack of bonding of cement at the interfaces between the cement and the borehole or pipe. This increase in amplitude, however, is an erroneous representation because the amplitide of the sonic signal is affected by the epoxy and grit-like material. Therefore, a customer has an uncertainty about the bonding of the cement at the interfaces along the pipe.

The present invention involves the use of a specially prepared pipe for lining a borehole in which the advantages of the epoxy rough coating are retained and the adverse effects of the epoxy rough coating to the logs obtained by a CBL tool are eliminated.

SUMMARY OF THE INVENTION

The present invention is in a pipe where the length of the pipe has intermittent coatings of grit-like particles bonded to the pipe leaving intermittent bare portions of the pipe, the intermittent coatings serving to enhance relative bonding between the cement and the pipe and the intermittent bare portions of the pipe serving to affect the sound transmission properties of the pipe so that a cement bond log can be obtained. The spacing of the intermittent coatings and bare portions of the pipe is related to the transmitter and receiver of a cement bond logging tool.

DESCRIPTION OF THE PREFERRED EMBODIMENT

Figure 1:
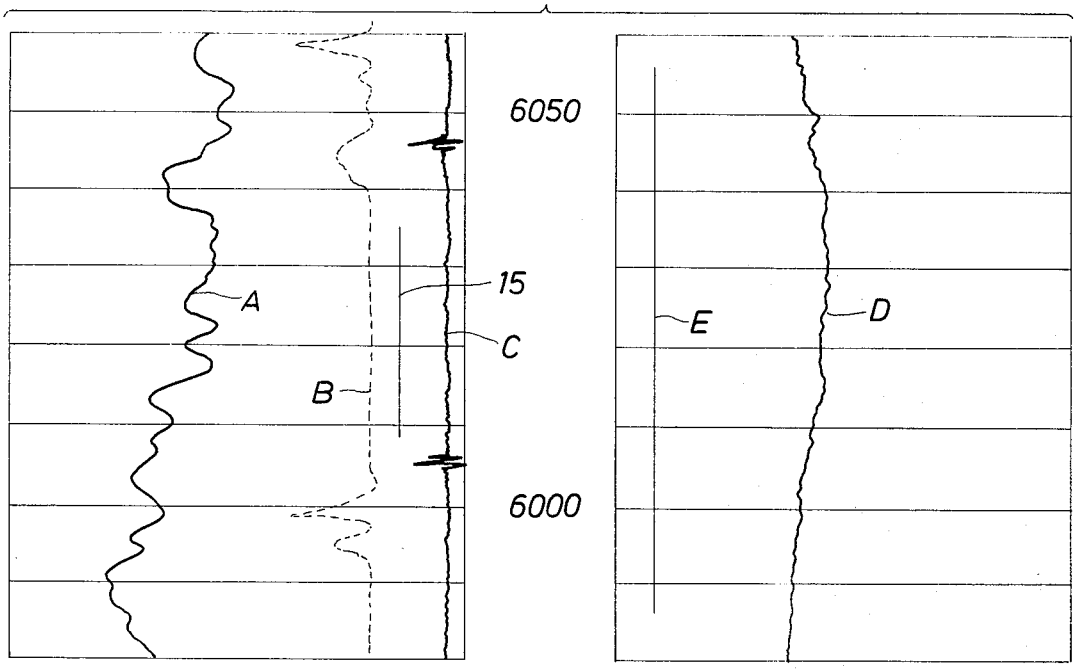
FIG. 1 illustrates a typical cement bond log obtained by a cement bond logging tool in a wellbore containing a pipe having a continuous grit particle coating.

Referring now to FIG. 1, a typical CBL log is illustrated for background purposes. The log is a plot of various measurements made by the tool as a function of depth. Curve A on the log is a typical gamma ray log obtained by a gamma ray tool. Curve B is a travel time log which indicates the $\Delta T$ or time required for a sonic signal to travel through a known length of casing or pipe. Curve C is a casing collar log obtained by a magnetic collar locator to indicate collar locations along the length of the string of pipe. On the right hand side of the log, the curve D indicates a plot of the amplitude of the measured sonic signal in a CBL tool and the line E represents the reference line at which the indication of bonding is measured.

As can be appreciated from the log, the curve D indicates a lack of bonding beween the pipe and cement or the pipe and the formations. The pipe utilized a continuous epoxy grit coating and thus, the CBL log does not give a proper indication of the degree of bonding.

Referring to a reference line 15 drawn with respect to the curve B, the reference line 15 illustrates average travel time through a casing or pipe and it can be seen that the travel time log increases while the CBL tool goes through the pipe. By use of the present invention, the log of travel time obtained by the CBL tool will not be distorted nor will the amplitude measurements which indicate bonding be disturbed.

Figure 2:
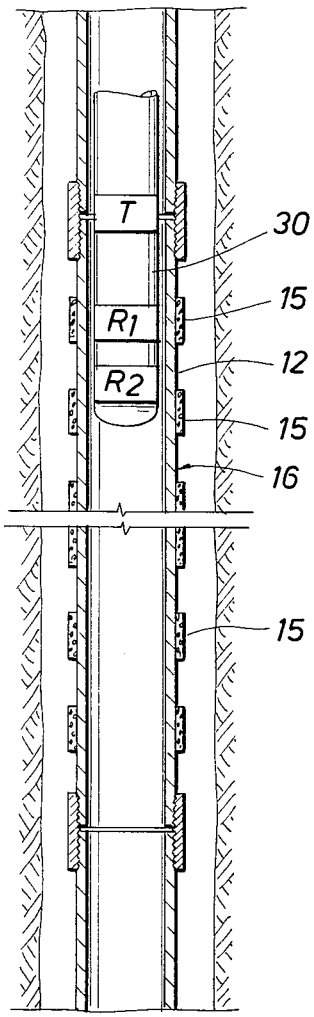
FIG. 2 illustrates a pipe constructed in accord with the present invention.

Referring now to FIG. 2, the present invention is illustrated. A tubular string of pipe 12 made of metal or the like and comprised of a string of pipe joints coupled to one another is located in a borehole. Along the length of the outer surface of the pipe 12 are intermittent epoxy coatings 15 containing grit-like materials. The coatings 15 are provided in one foot lengths with one foot of spacing 16 between adjacent coatings along the length of the pipe for reasons which will be made more apparent later. With the rough surface coatings 15 intermittently along the pipe, the rough surface on the pipe will enhance the bon-ding of cement to the outer surface of the pipe.

Figure 3:
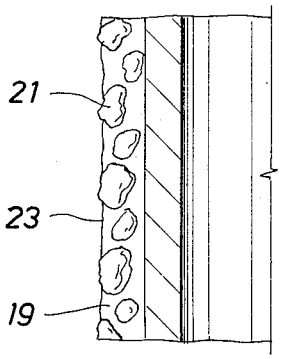
FIG. 3 is an enlarged fragmentary view taken from FIG. 2 to illustrate grit-like particles bonded to the pipe.

The rough coated surfaces 15 on the pipe are provided by bonding solid grit-like particles (sand, metal or the like) to the pipe surface by a suitable binder such as epoxy resin and with a suitable thickness. Thus, as shown in FIG. 3, the outer surface 23 of the epoxy resin 19 has particles of sand or flint 21 mixed with or added thereto so as to provide a sandpaper like roughness and to cause the cement to bond to the pipe.

Referring again to FIG. 2, a CBL tool 30 is illustrated with a transmitter T and receivers R1 and R2. The transmitter to receiver ($TR_1$) spacing is typically three feet and the spacing between receivers R1 and R2 is two feet. By adjusting the length of the rough coatings 15 on the pipe to one foot and the spacing 16 between the rough coatings 15 to one foot, it can be assured that in any three foot interval between the transmitter there will be at least one foot of uncoated or bare pipe.

It will be appreciated that the $TR_1$ spacing commonly in use at present is three feet, that this spacing may be varied and thus the spacing of two coating segments and a bare portion on the pipe may vary accordingly.

In the operation of a CBL, the tool is typically designed to sense a selected peak amplitude at each of the receivers. Heretofore, the presence of a continuous grit-like coating has caused the selected peak amplitude to be increased because of the effect of the continuous epoxy coating. By use of the discontinuous coatings, the bare portion of the pipe removes the increased effect of the sound transmission in the coating and effectively permits the proper peak amplitude to be sensed. Thus, the advantages of the rough coating to enhance bonding are obtained and the spaced coatings will not adversely affect a CBL log.

It will be apparent to those skilled in the art that various changes may be made in the invention without departing from the spirit and scope thereof and therefore the invention is not limited by that which is enclosed in the drawings and specifications but only as indicated in the appended claims.

I claim:

1. A tubular pipe for use in a well bore including a tubular steel mandrel pipe having end means for attachment in a string of pipe;

said pipe having an outer surface between the ends of said pipe having intermittent coatings of grit-like materials bonded to the outer surface for bonding to cement in a borehole, said intermittent coatings providing uncoated intermittent portions on said pipe where the spacing between two intermittent coatings and an intermediate uncoated portion on the pipe is functionally related to the spacing between a transmitter and first receiver of a cement bond logging tool for providing uncoated section of pipe relative to a transmitter/receiver spacing on a cement bond logging tool and for removing the effects of the coatings from the responses of the cement bond logging tool.

2. The pipe as set forth in claim 1 wherein said intermittent coatings include an epoxy material and particulate materials.

3. The pipe as set forth in claim 1 wherein the length of each intermittent coating is one foot and the length of each uncoated section is one foot.

4. A method for completing a well comprising the steps of:

positioning a string of pipe in a well bore;

injecting a cement slurry into the annulus between the string of pipe and the bore and permitting the cement to cure, where the string of pipe has an outer surface having intermittent coatings of grit-like materials bonded to its outer surface for bonding to cement, said intermittent coatings providing uncoated intermittent portions on said pipe;

moving a cement bond logging tool through said string of pipe where the spacing between the transmitter and receiver of the cement bond logging tool is functionally related to the spacing between two intermittent coatings and an intermediate uncoated portion on the pipe to provide uncoated section of pipe relative to the transmitter and receiver of the cement bond logging tool and for obtaining a cement bond log of the cemented string of pipe in which the effects of the coatings are removed from the cement bond logging tool.

* * * * *